United States Patent [19]

Euler

[11] B 3,995,687

[45] Dec. 7, 1976

[54] WATER COOLING SYSTEM FOR A SHAFT TYPE FURNACE

[75] Inventor: Horst Euler, Rumeln-Kaldenhausen, Germany

[73] Assignee: Demag Aktiengesellschaft, Duisburg, Germany

[22] Filed: Jan. 22, 1975

[21] Appl. No.: 543,078

[44] Published under the second Trial Voluntary Protest Program on February 17, 1976 as document No. B 543,078.

[30] Foreign Application Priority Data

Jan. 26, 1974 Germany ..... 2403741

[52] U.S. Cl. ..... 165/13; 165/107; 165/137; 266/190; 432/233

[51] Int. Cl.[2] ..... F28F 27/00

[58] Field of Search ..... 165/13, 134, 107, 137, 165/33, 1; 137/340; 266/32; 432/233

[56] References Cited

UNITED STATES PATENTS 3,059,913 10/1962 Sands ..... 165/107 X 3,236,297 2/1966 Costes ..... 165/134 X

*Primary Examiner*—Albert W. Davis, Jr.
*Attorney, Agent, or Firm*—Toren, McGeady and Stanger

[57] ABSTRACT

In a closed circuit system for circulating cooling water to various parts of a shaft type furnace, particularly a blast furnace, the closed circuit includes a water cooling device and two separate feed lines disposed in parallel and each arranged to cool different parts of the furnace. Two tanks are connected to the closed circuit, one located above and the other below the circuit. An electric pump circulates the cooling water during normal operation. If a power failure occurs, the electric pump is shut down and one feed line is automatically cut out of the closed circuit and receives flow from the upper tank and discharges it into the lower tank. The other feed line continues to receive the cooling water circulated through the closed circuit including the cooling device by an internal combustion driven pump which is started up when the power failure occurs.

9 Claims, 1 Drawing Figure

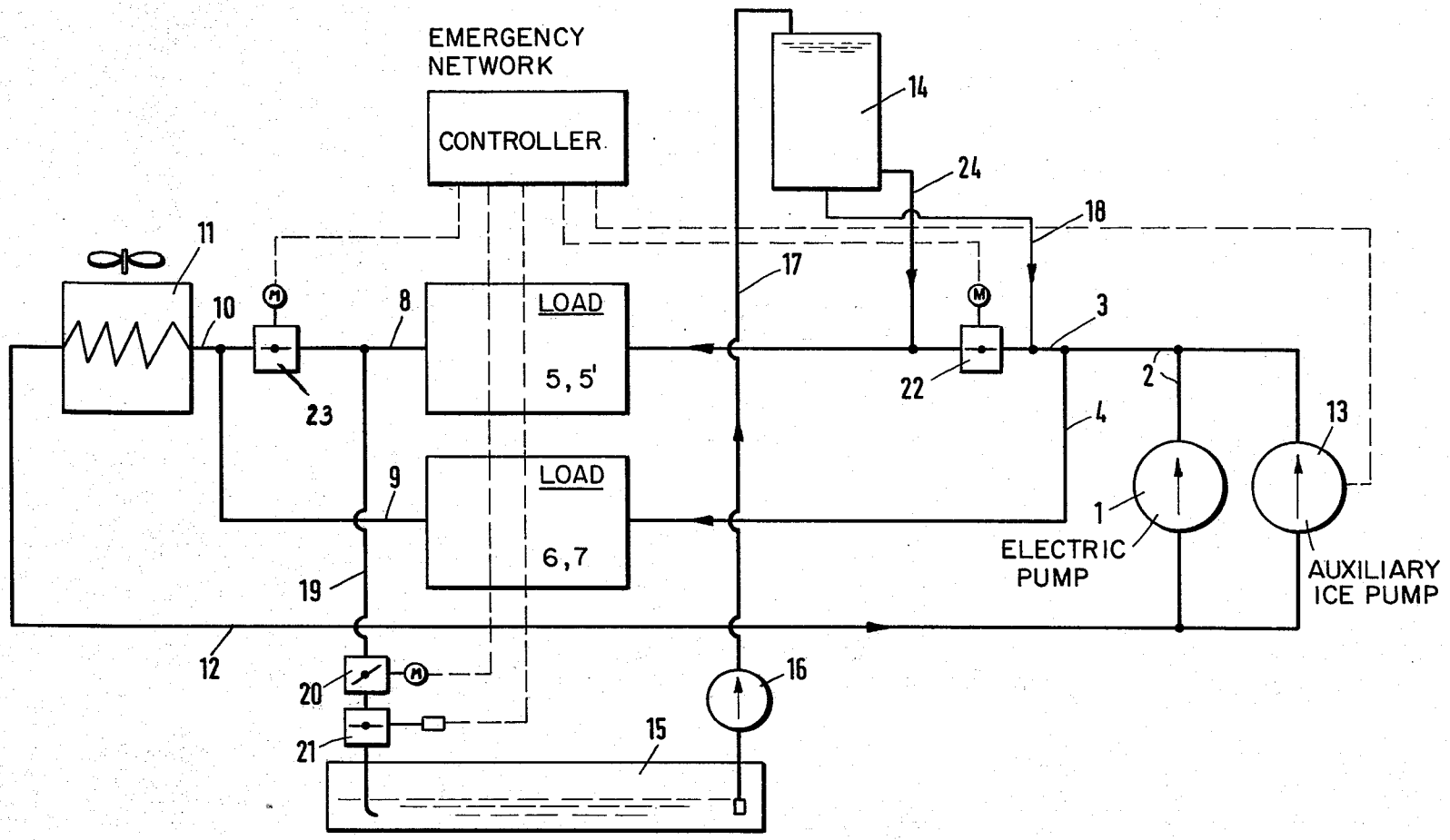
AUXILIARY ICE PUMP
ELECTRIC PUMP
EMERGENCY NETWORK
CONTROLLER
LOAD
5, 5'
LOAD
6, 7
1
2
3
4
8
9
10
11
12
13
14
15
16
17
18
19
20
21
22
23
24

WATER COOLING SYSTEM FOR A SHAFT TYPE FURNACE

SUMMARY OF THE INVENTION

The present invention is directed to a system for circulating water through a closed circuit for cooling a shaft type furnace, particularly a blast furnace, and, more specifically, it is directed to providing continued circulation of the cooling water during a power failure.

In known cooling systems for shaft type furnaces, the cooling water is circulated by one or a number of electric pumps. The cooling water flows through cooling spaces and cassettes as well as through the molds and hot blast slide valves and finally passes through a heat exchanger or cooling device where the water is cooled for recirculation. To prevent combustion due to a lack of water if a power failure occurs, a powerful emergency current unit must be provided in such conventional systems. The belated actuation of the unit or any trouble arising in its operation can have very serious consequences, for example, seizing may occur in the slide valves or the molds may blow out.

The present invention is directed to the problem of providing a cooling system which affords adequate cooling, at least of the most sensitive elements, with absolute certainty and in a simple and economical manner for the duration of a power failure. The minimum period for which the system affords adequate cooling during a power failure is 30 minutes.

In accordance with the present invention, the system for cooling shaft furnaces, particularly blast furnaces, includes a closed circuit for circulating a cooling water supply and containing a water cooling device and a tank located below the closed circuit, such as an underground tank. The cooling water is circulated by one or a number of electric pumps and another tank is located above the cooling circuit and connected to it for maintaining the water pressure in the system constant. The closed circuit contains feed lines arranged in parallel, for instance, one of the feed lines contains cooling spaces or boxes and cassettes, while the other feed line contains the molds and hot blast slide valves. When a power failure occurs one of the feed lines, such as the one supplying the cooling boxes and cassettes is automatically separated from the closed circuit with the cooling water flowing from the upper tank through the feed line into the lower tank. At the same time cooling water continues to pass through the closed circuit in the other feed line, cooling the molds and the hot blast slide valves, with the water being circulated by a pump operated by an emergency power unit or by an internal combustion engine. Further, the water continuing to flow in the closed circuit passes through the cooling device.

With such a system, a rapid and adequate cooling can be achieved for at least one hour in the event of a power failure. Experience has shown that power failures usually do not last longer than a half hour.

In a particularly expedient design of the present invention, shut off valves are arranged in the feed line which cools the cooling boxes and cassettes so that the line can be automatically separated from the remainder of the closed circuit when a power failure occurs. Further, this feed line is connected to the upper tank by a delivery pipe between the two shut off valves and a discharge pipe is also connected to the feed line downstream from the delivery pipe for conveying the cooling water, after its passage through the cooling boxes and cassettes, into the lower tank. The discharge pipe is provided with a throttle valve.

In another feature of the invention, if the drives for the two shut off valves and for the throttle valve are connected to the emergency network, and if a quick-opening valve is provided in the discharge pipe leading to the lower tank and is arranged to open automatically in the case of a power failure, when such a power failure occurs the circulating cooling water is automatically divided into two separate circuits. By dividing the system in this manner, an adequate and particularly rapid cooling of the heat-sensitive elements takes place, and the emergency network is only slightly loaded, especially when the circulating pump which is actuated during a power failure, is operated by an internal combustion engine. Switching the valves requires, during a brief period, an emergency power output with a maximum of 2 KW.

The operation of the completely automatic switching process will be explained in the description of the system which follows.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWING

The drawing is a schematic illustration of a closed circuit cooling system for a shaft type furnace and embodies the present invention.

DETAIL DESCRIPTION OF THE INVENTION

In the drawing a water cooling system is shown containing one or a number of electrically operated circulating pumps 1 for passing the cooling water into a pipeline 2 which branches into a pair of feed lines 3, 4 arranged in parallel. Each of the feed lines cools a different portion of the shaft furnace. Cooling boxes 5' and cassettes 5 are located in feed line 3, and molds 6 and hot blast slide valves 7 are positioned in feed line 4. Downstream of the cooling boxes 5' and cassettes 5 the cooling water flows into a delivery line 8, and downstream of the mold 6 and the slide valves 7 the cooling water flows into another delivery line 9 and these two delivery lines flow into a common line 10 which flows into a water cooling device 11, which is preferably air cooled. From the device 11, the cooled water flows through a return line 12 back to the circulating pumps 1. Disposed in parallel to the circulating pumps 1 is an additional circulating pump 13 which is placed in operation if a power failure occurs and preferably is driven by an internal combustion engine, such as a diesel engine.

An upper tank 14 is located at an adequate level above the closed cooling circuit to maintain the pressure of the circulating cooling water constant. The tank 14 has a capacity of at least one-quarter of the entire circulating amount of cooling water. If necessary, the tank 14 can be fed from another tank 15, such as an underground tank, located below the closed cooling circuit, by means of a pump 16 through a line 17. The water pressure in the closed cooling circuit is kept constant by a pressure equalizing line 18 which extends from the tank 14 to the feed line 3. However, as can be appreciated, the line 18 can also be connected to the lines 2 or 4.

Extending between the line 8 from the cooling boxes 5' and cassettes 5 and the lower tank 15 is a gravity line 19. A throttle valve 20 controlled by the emergency network and a shut off valve 21 which opens automatically at the moment of a power failure, are located in the gravity line 19.

The separation of the cooling water circuit into two separate flow circuits takes place automatically in the event of a power failure. The separation of the closed circuit into the two separate circuits is achieved through the two shut off valves 22, 23 which are always open during normal cooling operations and whose drives are connected to the emergency network. The shut off valve 22 is located in the feed line 3 adjacent to its point of junction with the other feed line 4 and upstream from the cooling boxes 5' and cassettes 5. The pressure equalizing line 18 is connected to the feed line 3 between the shut off valve 22 and the point of junction between the feed lines 3 and 4. An emergency line 24 is connected between the tank 14 and the feed line 3 downstream from the shut off valve 22. The second shut off valve 23 is located in the line 8 upstream from the junction point of lines 8 and 9 with line 10. Between the shut off valve 23 and the cooling boxes 5' and cassettes 5, the gravity line 19 flows from the line 8 to the tank 15.

If a power failure should occur in the closed circuit cooling system, the quick-opening valve 21, which has lost power, opens immediately. The normally closed cooling circuit is opened and initially the emergency water supply to all of the elements being cooled is effected from the tank 14 over the pressure equalizing line 18 and the emergency line 24. This cooling water flows to the lower tank 15 through the gravity line 19 with the flow through the gravity line being regulated by the throttle valve 20 controlled by the emergency network. This initial portion of the emergency cooling procedure takes about two minutes, approximately the time required for the actuation of the diesel operated circulating pump 13 which supplies the amount of cooling water required in the feed line 4 for the molds 6 and the hot blast slide valves 7. Since the shut off valves 22 and 23 are automatically closed with the switching over to the emergency network at power failure the formerly closed circuit is divided into the following two separate cooling water circuits:

1. From the upper tank 14 the cooling water flows through the emergency line 24 into feed line 3 downstream from the shut off valve 22, passes through the cooling boxes 5' and cassettes 5 and then flows through the gravity line 19 to the lower tank 15, the lower tank has at least the same capacity as the upper tank 14.

The two tanks 14 and 15 can be designed either of an open or closed construction. The closed construction requires covering the water surface with an inert gas, preferably nitrogen.

Depending on the amount of heat to be removed, the flow through the cooling boxes 5' and cassettes 5 can be regulated by the throttle valve 20 in the gravity line 19. With the upper tank 14 filled with 25% of the total circulating amount, a down time of up to one hour can be accommodated with the cooling water temperature rising, from about 50° to a maximum of 80°C.

2. With the start up of the diesel operated circulating pump 13, the molds 6 and hot blast slide valves 7 receive cooling water through the lines 2 and 4 and after the water has extracted heat it continues its flow path through the lines 9 and 10 to the cooling device 11 and then passes through return line 12 to the circulating pump 13. Because of the high current consumption involved, the fan motors of the air cooling device 11 are not connected to the emergency network. Nevertheless, the cooling water circuit can be maintained for several hours before the water reaches a temperature of 80°C, since the water cooling device is designed for the total cooling circuit and the temperature gradient normally extends from 65° to 50°C. Due to the considerably reduced flow through the cooling device, the amount of cooling effected by convection only is sufficient.

When the power failure is over, the return of power places the quick-opening valve 21 in the closed position and the pump 16 moves the water out of the lower tank 15 through line 17 into the upper tank 14. As soon as the electric circulating pump resumes operation, the shut off valves 22, 23 open and the normal closed circuit flow through both the feed lines 3 and 4 is restored.

Where the total or entire circulating amount of cooling water is referred to in the specification, it means the amount in the closed circuit at any given time.

While a specific embodiment of the invention has been shown and described in detail to illustrate the application of the inventive principles, it will be understood that the invention may be embodied otherwise without departing from such principles.

What is claimed is:

1. In a water cooling system for shaft furnaces, such as blast furnaces, comprising a closed circuit, a water cooling device located in said closed circuit, a first storage tank located below said closed circuit, at least one electric pump located in said closed circuit for circulating the cooling water, a second storage tank located above said closed circuit, and a pipe connecting said second storage tank to said closed circuit for maintaining a constant water pressure in said closed circuit, wherein the improvement comprises that said closed circuit includes a first feed line for cooling one portion of the shaft furnace and a second feed line disposed in parallel with said first feed line for cooling another portion of the shaft furnace, valve means in said first feed line for separating it from the flow through said closed circuit and said valve means arranged to operate automatically in a power failure affecting said at least one electric pump circulating the cooling water through said closed circuit, pipe means connecting said first feed line to said first and second storage tanks for providing flow from said second storage tank through said first feed line to said first storage tank when said first feed line is separated from said closed circuit, and an emergency pump located in said closed circuit and arranged to operate when a power failure occurs for circulating the cooling water through said second feed line in said closed circuit, said water cooling device located in said closed circuit spaced from said first feed line so that the cooling water passes through said water cooling device when a power failure occurs.

2. In a water cooling system, as set forth in claim 1, wherein said first feed line is arranged in parallel with said second feed line in said closed circuit between a first upstream point and a second downstream point, said valve means comprises a first valve located in said first feed line downstream of said first upstream point and upstream of the one portion of the shaft furnace located within said first feed line, and a second valve located in said first feed line upstream from the second downstream point and downstream from the one portion of the shaft furnace located within said first feed line, each said first and second valve is arranged to shut off flow through said first feed line into said closed circuit when a power failure occurs, a delivery pipe connected between said second storage tank and said first feed line downstream of said first valve and upstream of the one portion of the shaft furnace located in said first feed line, a return pipe connected at one end to said first storage tank and at its other end to said first feed line between the second downstream point and the one portion of the shaft furnace in said first feed line, and valve means located in said return line for regulating flow therethrough.

3. In a water cooling system, as set forth in claim 2, wherein said valve means in said return line comprises a throttle valve.

4. In a water cooling system, as set forth in claim 2, wherein said valve means in said return line comprises a throttle valve and a quick-opening valve located downstream of said throttle valve and arranged to open automatically when a power failure occurs.

5. In a water cooling system, as set forth in claim 2, including an emergency network for operating the cooling system during a power failure, and said first and second valves and said throttle valve being connected to said emergency network.

6. In a water cooling system, as set forth in claim 1, wherein said pipe connecting said second storage tank to said closed circuit for maintaining a constant water pressure is connected to said first feed line upstream of said first valve and downstream of the first upstream point connecting said first and second feed lines.

7. In a water cooling system, as set forth in claim 1, wherein said second storage tank has a capacity of at least one-quarter of the total circulating amount of cooling water.

8. In a water cooling system, as set forth in claim 1, including a connecting line extending between said first and second tanks, and a pump in said connecting line for supplying cooling water from said first tank to said second tank.

9. In a water cooling system, as set forth in claim 1, wherein said emergency pump includes an internal combustion engine drive.

* * * * *